United States Patent [19]

Haku et al.

[11] Patent Number: 4,786,572

[45] Date of Patent: Nov. 22, 1988

[54] ELECTROPHOTOGRAPHIC MEMBER WITH SILICIDE INTERLAYER

[75] Inventors: Hisao Haku, Neyagawa; Kazuyuki Goto; Masaru Takeuchi, both of Hirakata; Takeo Fukatsu, Uji; Yukinori Kuwano, Katano, all of Japan

[73] Assignee: Sanyo Electric Co., Ltd., Osaka, Japan

[21] Appl. No.: 75,129

[22] Filed: Jul. 20, 1987

Related U.S. Application Data

[63] Continuation-in-part of Ser. No. 896,617, Aug. 14, 1986, Pat. No. 4,681,826, which is a continuation-in-part of Ser. No. 640,314, Aug. 13, 1984, Pat. No. 4,624,905.

[30] Foreign Application Priority Data

Feb. 14, 1984 [JP] Japan ..... 59/26254
Feb. 14, 1984 [JP] Japan ..... 59/26255

[51] Int. Cl.[4] ..... G03G 5/14; G03G 5/082

[52] U.S. Cl. ..... 430/60; 430/65

[58] Field of Search ..... 430/60, 65, 96

[56] References Cited

U.S. PATENT DOCUMENTS 4,356,246 10/1982 Tabei et al. ..... 430/96 X
4,582,772 4/1986 Teuscher et al. ..... 430/65 X

*Primary Examiner*—Roland E. Martin
*Attorney, Agent, or Firm*—Bryan, Cave, McPheeters & McRoberts

[57] ABSTRACT

An electrophotographic photosensitive member comprising (a) a substrate made of an electrically conductive material, (b) a silicide layer formed on the surface of the substrate, and (c) a photoconductive layer superposed on the silicide layer being composed chiefly of amorphous silicon; which is usable for copying machines and intelligent copying machine.

4 Claims, 7 Drawing Sheets

ELECTROPHOTOGRAPHIC MEMBER WITH SILICIDE INTERLAYER

This application is a continuation-in-part of application Ser. No. 896,617, filed on Aug. 14, 1986, now U.S. Pat. No. 4,681,826 granted on July 21, 1987; which application was in turn a continuation-in-part of application Ser. No. 640,314 filed on Aug. 13, 1984, now U.S. Pat. No. 4,624,905 granted on Nov. 25, 1986.

BACKGROUND OF THE INVENTION

1. Field of the Invention

The present invention relates to an electrophotographic photosensitive member including a photoconductive layer which is composed chiefly of amorphous silicon.

2. Description of the Prior Art

Electrophotographic photosensitive members which are composed chiefly of amorphous silicon are disclosed, for example, in U.S. Pat. Nos. 4,394,426, 4,359,514, 4,414,319, 4,418,132, 4,423,133, 4,771,042, etc. Such photosensitive members have various advantages over those composed chiefly of selenium or cadmium sulfide in that they have higher resistance to heat and abrasion, are harmless and have higher photosensitivity. Furthermore these members have the advantage that they are usable for copying machines and intelligent copying machines including a laser printer because of sufficient sensitivity to light of long wavelengths.

When amorphous silicon is used for electrophotographic photosensitive members, the photoconductive layer formed on the substrate must have a sufficient thickness so as to have a high dark resistivity and to obtain the amount of charge required for the developing process. The photosensitive member has a surface layer for preventing the flow of surface charges from the surface of the member into the photoconductive layer. The surface layer is made of a material composed chiefly of amorphous silicon and containing nitrogen, carbon or oxygen.

However, the photoconductive layer when it has sufficient thickness, tends to release or peel from the substrate so that the electrophotographic photosensitive member comprising the photoconductive layer has insufficient in its durability for use. Larger thickness of the photoconductive layer result in higher releasability or peelability.

SUMMARY OF THE INVENTION

The present invention provides an electrophotographic photosensitive member comprising:

(a) a substrate made of an electrically conductive material, (b) a silicide layer formed on the surface of the substrate; and (c) a photoconductive layer superposed on the silicide layer being composed chiefly of amorphous silicon.

The electrophotographic photosensitive member of the present invention may further include a blocking layer between the silicide layer and the photoconductive layer. Preferably the blocking layer is composed chiefly of amorphous silicon and contains a substance for blocking flow of carriers from the substrate into the photoconductive layer when combined with the amorphous silicon, the content of the substance being high toward the substrate and low toward the photoconductive layer.

In an electrophotographic photosensitive member of the present invention, the photoconductive layer forms a high-strength bond with the substrate through the silicide layer so that the durability of the photosensitive member is remarkably improved.

BRIEF DESCRIPTION OF THE INVENTION

DESCRIPTION OF THE PREFERRED EMBODIMENTS

Substrate

Figure 1:
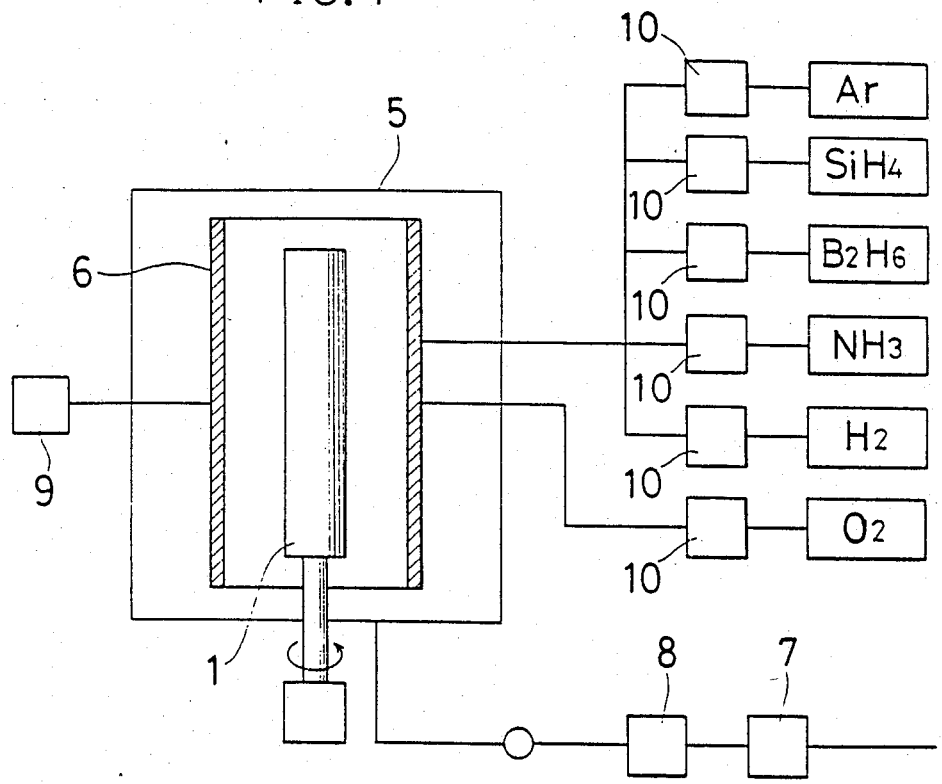
FIG. 1 is a diagram showing an example of apparatus for preparing an electrophotographic photosensitive member of the present invention.

The substrate of the electrophotographic photo sensitive member of the invention can be one which is already known in the art. Thus, it is usually in the form of a drum or belt. It is usually made of an electrically conductive material such as aluminum or stainless steel. The substrate made of the conductive material may be coated with a substance having a greater work function, such as Au, Cr, Cu, Ni, Pd, Pt, W, Mo, Ag or Ti, by vacuum evaporation or plating. Although the substrate may of course be without any coating, it is then desired that the substrate have a surface polished, for example, to a roughness of up to 0.1 μm and/or be made of a highly purified conductive material, so as to be free from surface defects due to the presence of impurities.

Furthermore, the substrate may be a nonmetallic heat generating body of silicon carbide, boron oxide, aluminum nitride, alumina, boron nitride or the like which has a ground electrode. When such a substrate is used, the photosensitive member can be easily heated, for example, to 40° to 50° C. when it is to be used. This serves to prevent flow of images due to the condensation of water vapor on the photosensitive member.

Besides, an under-coating layer may be formed between the substrate and the blocking layer in order to strengthen adherence therebetween.

The under-coating layer can be prepared from a source gas for forming amorphous silicon, in which when the substrate is aluminum, a little amount of alkyl aluminum compound such as $(CH_3)_3Al$, $(CH_3)_2AlH$, $CH_3AlH_3$, $(C_2H_5)_3Al$, $(C_2H_5)_2AlH$, $C_2H_5AlH_2$ or the like is added. The preferred alkyl aluminum compound is $(CH_3)_3Al$ or $(C_2H_5)_3Al$.

Silicide layer

The silicide layer, which is characteristic of the present invention, is formed on the surface of the substrate. Examples of the silicides are Co, Mo or W silicide, among which Mo silicide and W silicide are preferred. The silicide layer has a thickness of suitably 10–10000 Å and may be prepared by the method known in the art (see Examples).

Photoconductive layer

The photosensitive member of the present invention includes a photosensitive layer which is composed chiefly of amorphous silicon (hereinafter referred to as "a-Si"). The layer may be made chiefly of i-type a-Si, p-type a-Si (containing a Group III element added thereto) or n-type a-Si (incorporating a Group V element). The concentration of a Group III or V element is suitably $5\times10^{15}$ to $5\times10^{18}$ atoms/cm$^3$. The layer may be made of p-type a-Si at the substrate side thereof and n-type a-Si at the other side thereof adjacent the surface layer so as to have a high resistivity. Further in order to give a high resistivity to the layer, O, C, N or the like may be added to such a material. It is desirable to give the layer a resistivity of $10^9$ to $10^{12}$ ohm-cm and therefore to add impurities so as to afford such a resistivity. The amount of O to be added to give the desired resistivity is $2.5\times10^{19}$ to $1.5\times10^{22}$ atoms/cm$^3$. The corresponding amount of C or N is $5\times10^{21}$ to $4.5\times10^{22}$ atoms/cm$^3$. The layer may be formed from a-Si having added thereto as impurities a small amount of an organic compound which comprises a Group III element, such as $[(CH_3)_3Al]_2$, $(C_2H(CH_3)_3Ga$, $(C_2H_5)_3Ga$, $(C_2H_5)_3$-In or the like.

The preferred photoconductive layer is p-type a-Si layer, n-type a-Si layer or high-resistivity layer. The layer must have a thickness sufficient to obtain an amount of charges required for the developing process. More specifically, the layer is usually about 5 to about 80 μm in thickness.

Surface layer

The surface layer is provided primarily to prevent the charges provided on the free surface of the photosensitive member from flowing into the photoconductive layer and impairing the initial charge characteristics of the member. For this purpose, the layer is preferably a highresistivity layer. The surface layer is composed chiefly of a-Si. To give a high resistivity to the layer, the a-Si has added thereto a substance which forms an insulating material when combined with the a-Si.

A useful substance for forming the insulating material is carbon. The carbon sources are hydrocarbons which can be represented by $C_nH_{2n+2}$, $C_nH_{2n}$ or $C_nH_{2n-2}$ where n is an integer, such as $CH_4$, $C_2H_6$, $C_3H_8$, $C_2H_4$, $C_3H_6$, $CH_2H_2$ or the like, and may be used in admixture thereof. The other carbon sources are organosilanes which can be represented by $R_4Si$, $R_3SiH$, $R_2SiH_2$ or $RSiH_3$ where R is for example a lower alkyl such as methyl or ethyl.

The content of the substance (i.e., carbon) based on the silicon atoms is suitably low toward the substrate and high toward its surface. More specifically, the content is desirably 0.01 to 30 atomic % toward the substrate and 1 to 51 atomic % toward its surface. The most desirable content is 10 to 20 atomic % toward the substrate and 30 to 50 atomic % toward its surface. The term "atomic %" means the number of atoms of the substance contained per 100 atoms of the silicon. Preferably the content gradually increases from the substrate side toward the surface side. When having a higher content at the surface side, the surface layer possesses enhanced ability to retain surface charges (in other words, to prevent flow of charges into the photoconductive layer) and increased surface strength. On the other hand, the lower content at the substrate side serves to minimize the reduction of the photosensitivity.

The surface layer has a thickness of about 0.1 to about 20 μm, suitably about 0.1 to about 5 μm, preferably about 0.5 to about 1.5 μm. This thickness is much larger than that of conventional surface layers which is about 30 to about 1000 Å, i.e. about 0.003 to about 0.1 μm, so that the layer is easy to make. Accordingly the layer is unlikely to have variations in its thickness and is useful for giving uniform copy images. On the other hand, despite the large thickness, the carriers entering the surface layer are easily movable since the content of the insulation-forming substance is lower at one side thereof adjacent the photoconductive layer. Further, when the content is made to decrease from the free surface side of the surface layer toward the photoconductive layer, the carriers are movable with greater ease.

The surface layer may have incorporated therein a small amount of Group III or V element or an organic compound containing Group III metal (see examples given for the photoconductive layer) as impurities. The amount is usually $10^{-6}$ to $10^{-3}$ atomic %.

Blocking layer

Preferably the photosensitive member of the present invention has a blocking layer between the substrate and the photoconductive layer. The blocking layer has the function of preventing flow of carriers from the substrate into the photoconductive layer when the photosensitive member is charged and permitting the carriers produced by electromagnetic irradiation (as with light) in the photoconductive layer and moving toward the substrate to flow into the substrate. The blocking layer can be prepared from a-Si to which boron or phosphorus is added. Usually $B_2H_6$ gas is used as the boron source, and $PH_3$ gas as the phosphorus source. Boron or phosphorus combines with the a-Si, forming a material for preventing flow of carriers from the substrate into the photoconductive layer. The boron source is used for forming the carrier blocking material when the photosensitive member is to be charged positively, or the phosphorus source is used for the same purpose when the member is to be charged negatively.

Besides, in addition to the above boron or phosphorus sources, may add a small amount of an organic compound having Group III element which can be represented by $R_3H$, $R_2MH$ or $RMH_2$ where R is for example a lower alkyl and M is B, Al, Ga, In or Tl, or an organic compound having Group V element which can be represented by $R_3X$, $R_2XH$ or $RXH_2$ where R is the same as above and X is N, P, As, Sb or B.

In order to obtain insulation property, $N_2O$, NO, $CO_2$, $O_2$, $NH_3$ or $N_2$ may be added to the a-Si.

We have found it preferable to make the content of the additive high toward the substrate and low toward the photoconductive layer. More specifically, the additive content based on the Si atoms is $10^3$ to $10^5$ atomic ppm toward the substrate and 10 to $10^3$ atomic ppm toward the photoconductive layer. Preferably the content has a gradient. The layer of the above structure facilitates movement of carriers which tend to flow toward the substrate while preventing carriers from moving from the substrate toward the photoconductive layer. This serves to preclude the reduction of the photosensitivity.

The blocking layer is about 0.05 to about 1 μm in thickness.

The blocking layer can be a silicide layer of $CoSi_2$, $Pb_2Si$, $MoSi_2$, $WSi_2$ or the like, or a hetero element layer of $Cu_2O$, PbO, FeO, NiO, GaP, InP, GaAlAs or the like.

According to the invention, the blocking layer, the photoconductive layer and the surface layer can be formed over the substrate by the CVD, PVD, spattering or like known process with use of a known apparatus. However, for forming the blocking layer over the substrate and the surface layer over the photoconductive layer, it is desirable to treat the substrate surface and the photoconductive layer surface with plasma in an Ar, $H_2$, $NH_3$ or like gas atmosphere to assure improved adhesion and to reduce electron traps at the interface.

REFERENCE EXAMPLES I TO V AND COMPARATIVE EXAMPLES I TO IV

A process for fabricating electrophotographic photosensitive members will be described with reference to the following examples. FIG. 1 shows a hollow cylindrical closed container 5 internally equipped with a hollow cylindrical electrode 6. An aluminum substrate 1 having a superfinished surface for making a photosensitive member is rotatably inserted into the electrode 6.

(Formation of blocking layer)

With the substrate 1 thus mounted in place, the interior of the container 5 is evacuated to a vacuum of about $1\times10^{-6}$ atm. by a rotary pump 7 and a mechanical booster pump 8. The substrate is thereafter heated to 200° to 300° C. by an unillustrated heater (inserted in the substrate 1) while being rotated at 10 r.p.m. Next, Ar gas and $H_2$ are introduced into the closed container 5 at a flow rate of 200 c.c./min., and glow discharge is caused to occur across the electrode 6 and the substrate 1 for pre-treatment. Subsequently the gas mixture is evacuated from the container 5, into which $B_2H_6$ gas is then admitted along with $SiH_4$ gas and $H_2$ gas which are bases, to maintain the container 5 at a gas pressure of $1\times10^{-3}$ atm. The ratio of $B_2H_6$ gas to $SiH_4$ gas to be mixed therewith is controlled to a specified value by the corresponding mass flow controllers 10. However, the supply of $B_2H_6$ is decreased gradually. In this state, high-frequency power having a frequency of 13.56 MHz is applied to the substrate by a radio-frequency source 9 to cause plasma discharge. In a given period of time, a blocking layer 2 is formed over the substrate 1.

(Photoconductive layer)

After removing the gas mixture from the closed container 5, a specified quantity of $O_2$ gas is introduced into the container along with the above-mentioned gases, followed by the same discharge as above, whereby a photoconductive layer 3 is formed over the blocking layer 2.

(Formation of surface layer)

The gas mixture is then removed from the closed container 5, into which $SiH_4$ gas, $H_2$ gas and $CH_4$ gas are thereafter introduced in a specified ratio to cause discharge. $CH_4$ gas is supplied at a rate gradually increasing with time as controlled by the corresponding mass flow controller 10, whereby a surface layer 4 is formed.

The actual flow ratio of pure $CH_4$ gas to pure $SiH_4$ gas ($CH_4/SiH_4$) is 0.01–2.0, preferably 0.2–1.0 for a part toward the substrate and 0.1–10, preferably 0.4–6.0 for a part toward free-surface.

Figure 2:
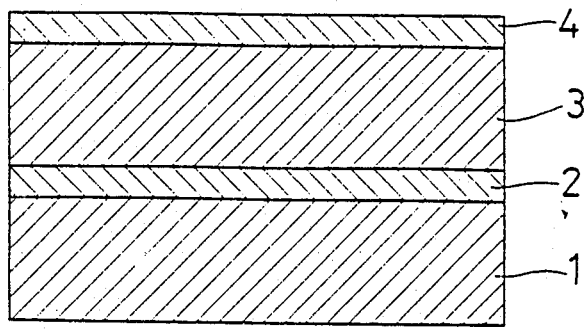
FIG. 2 is a diagram showing photosensitive member of the reference example.

In this way, a photosensitive member is obtained which has the structure shown in FIG. 2. In Reference Examples I to IX and Comparative Examples I to IV, photosensitive members were prepared by the above process under varying conditions as listed in Table 1.

The surface layer of the members in Comparative Examples III and IV is formed by the addition of oxygen source instead of carbon source for giving insulating property.

TABLE 1

| Reference Example | Layer | | $SiH_4$ (cc/min) | $B_2H_6/SiH_4$ (ppm) | $O_2/SiH_4$ | $H_2/SiH_4$ | $CH_4/SiH_4$ | $N_2O/SiH_4$ | Thickness of layer (μm) |
|---|---|---|---|---|---|---|---|---|---|
| I | Blocking layer | Start | 100 | 5000 | 0 | 1.0 | 0 | 0 | 1.0 |
| | | End | 100 | 500 | 0 | 1.0 | 0 | 0 | |
| | Photoconductive | layer | 300 | 10 | 0.02 | 0.2 | 0 | 0 | 14 |
| | Surface layer | Start | 100 | 0 | 0 | 1.0 | 0.5 | 0 | 1.0 |
| | | End | 50 | 0 | 0 | 2.0 | 4.0 | 0 | |
| II | Blocking layer | Start | 100 | 5000 | 0 | 1.0 | 0 | 0 | 1.0 |
| | | End | 100 | 500 | 0 | 1.0 | 0 | 0 | |
| | Photoconductive | layer | 300 | 10 | 0.02 | 0.2 | 0 | 0 | 14 |
| | Surface layer | Start | 100 | 0 | 0 | 2.0 | 0.5 | 0 | 1.0 |
| | | End | 35 | 0 | 0 | 4.0 | 5.0 | 0 | |
| III | Blocking layer | Start | 100 | 5000 | 0 | 1.0 | 0 | 0 | 1.0 |
| | | End | 100 | 500 | 0 | 1.0 | 0 | 0 | |
| | Photoconductive | layer | 300 | 1 | 0.003 | 0.2 | 0 | 0 | 14 |
| | Surface layer | Start | 100 | 0 | 0 | 2.0 | 0.8 | 0 | 0.5 |
| | | End | 50 | 0 | 0 | 4.0 | 4.0 | 0 | |
| IV | Blocking layer | Start | 100 | 5000 | 0 | 1.0 | 0 | 0 | 1.0 |
| | | End | 100 | 500 | 0 | 1.0 | 0 | 0 | |
| | Photoconductive | layer | 300 | 10 | 0.02 | 0.2 | 0 | 0 | 14 |
| | Surface layer | Start | 100 | 10 | 0 | 2.0 | 0.2 | 0 | 1.0 |
| | | End | 50 | 10 | 0 | 4.0 | 2.0 | 0 | |
| V | Blocking layer | Start | 100 | 2000 | 0 | 1.0 | 0 | 0 | 1.0 |
| | | End | 100 | 2000 | 0 | 1.0 | 0 | 0 | |
| | Photoconductive | layer | 300 | 20 | 0.02 | 0.2 | 0 | 0 | 14 |
| | Surface layer | Start | 100 | 0 | 0 | 1.0 | 0.5 | 0 | 1.0 |
| | | End | 50 | 0 | 0 | 4.0 | 4.0 | 0 | |
| VI | Blocking layer | Start | 100 | 5000 | 0 | 1.0 | 0 | 0 | 1.0 |
| | | End | 100 | 500 | 0 | 1.0 | 0 | 0 | |
| | Photoconductive | I | 300 | 10 | 0.02 | 0.2 | 0 | 0 | 12 |
| | layer | II | 300 | 0 | 0 | 0.2 | 0 | 0 | 2 |
| | | III | 300 | 10 | 0.02 | 0.2 | 0 | 0 | 0.1 |
| | Surface layer | Start | 100 | 0 | 0 | 1.0 | 0.5 | 0 | 1.0 |
| | | End | 35 | 0 | 0 | 2.0 | 4.0 | 0 | |
| VII | Blocking layer | Start | 100 | 5000 | 0 | 1.0 | 0.1 | 0 | 0.5 |
| | | End | 100 | 500 | 0 | 1.0 | 0.1 | 0 | |
| | Photoconductive | layer | 300 | 10 | 0.02 | 0.2 | 0.05 | 0 | 14 |
| | Surface layer | Start | 100 | 0 | 0 | 1.0 | 0.8 | 0 | 0.5 |
| | | End | 50 | 0 | 0 | 4.0 | 4.0 | 0 | |
| VIII | Blocking layer | Start | 100 | 5000 | 0 | 1.0 | 0 | 0.02 | 1.0 |
| | | End | 100 | 500 | 0 | 1.0 | 0 | 0.02 | |

TABLE 1-continued

| | Layer | | $SiH_4$ (cc/min) | $B_2H_6/SiH_4$ (ppm) | $O_2/SiH_4$ | $H_2/SiH_4$ | $CH_4/SiH_4$ | $N_2O/SiH_4$ | Thickness of layer (μm) |
|---|---|---|---|---|---|---|---|---|---|
| | Photoconductive | layer | 300 | 1 | 0.003 | 0.2 | 0 | 0 | 14 |
| | Surface layer | Start | 100 | 10 | 0 | 1.0 | 0.4 | 0 | 0.5 |
| | | End | 50 | 10 | 0 | 4.0 | 4.0 | 0 | |
| IX | Blocking layer | Start | 100 | 2000 | 0 | 1.0 | 0 | 0 | 1.0 |
| | | End | 100 | 2000 | 0 | 1.0 | 0 | 0 | |
| | Photoconductive | layer | 300 | 10 | 0.02 | 0.2 | 0 | 0 | 14 |
| | Surface layer | Start | 100 | 0 | 0 | 1.0 | 0.1 | 0 | 0.5 |
| | | End | 50 | 0 | 0 | 4.0 | 0.4 | 0 | |
| Example | | | | | | | | | |
| Comp. Ex. I | Photoconductive | layer | 300 | 10 | 0.02 | 0.2 | 0 | 0 | 15 |
| Comp. Ex. II | Blocking layer | | 100 | 2000 | 0 | 1.0 | 0 | 0 | 1.0 |
| | Photoconductive | layer | 300 | 10 | 0.02 | 0.2 | 0 | 0 | 14 |
| | Surface layer | | 50 | 0 | 0 | 2.0 | 2.0 | 0 | 0.5 |
| Comp. Ex. III | Blocking layer | | 100 | 2000 | 0 | 1.0 | 0 | 0 | 1.0 |
| | Photoconductive | layer | 300 | 10 | 0.02 | 0.2 | 0 | 0 | 22 |
| | Surface layer | | 100 | 0 | 0.2 | 0.1 | 0 | 0 | 1.0 |
| Comp. Ex. IV | Blocking layer | | 100 | 2000 | 0 | 1.0 | 0 | 0 | 1.0 |
| | Photoconductive | layer | 300 | 10 | 0.02 | 0.2 | 0 | 0 | 18 |
| | Surface layer | Start | 100 | 0 | 0.2 | 1.0 | 0 | 0 | 1.0 |
| | | End | 50 | 0 | 0.6 | 0.2 | 0 | 0 | |

The photosensitive members (drums) obtained were tested for the evaluation of performance.

(Test methods)

(i) Variations in the amount of charge

The photosensitive drum is subjected to corona discharge under specified conditions, and the surface potentional (amount of charge) on the drum is measured by a surface potentiometer (TREK MODEL 344). The variations in the potential values along the length of the drum are expressed in percentage, with the mean value taken as 1.

(ii) Copying test

The photosensitive drum is installed in a copying machine and used for making copies to check the number of copies that can be produced without blur of images.

(iii) Temperature-humidity cycle test

The photosensitive drum is subjected to temperature-humidity cycles under conditions involving an upper limit of 70° C. and 90%, and a lower limit of −10° C. and the highest possible humidity that can be maintained. The time taken for one cycle is 1 hour for the upper limit, 2 hours for the change from upper limit to lower limit, 1 hour for the lower limit and 2 hours for the change from lower limit to upper limit, i.e. 6 hours in total. The drum is thus subjected to temperature-humidity cycles for 1000 hours, then heated in a constant-temperature chamber at 80° C. for 30 minutes and thereby conditioned uniformly for measurement, and thereafter checked for characteristics.

The results are shown in Table 2, which also indicates the energy band diagrams obtained for Reference Examples I to VIII.

TABLE 2

Figure 3:
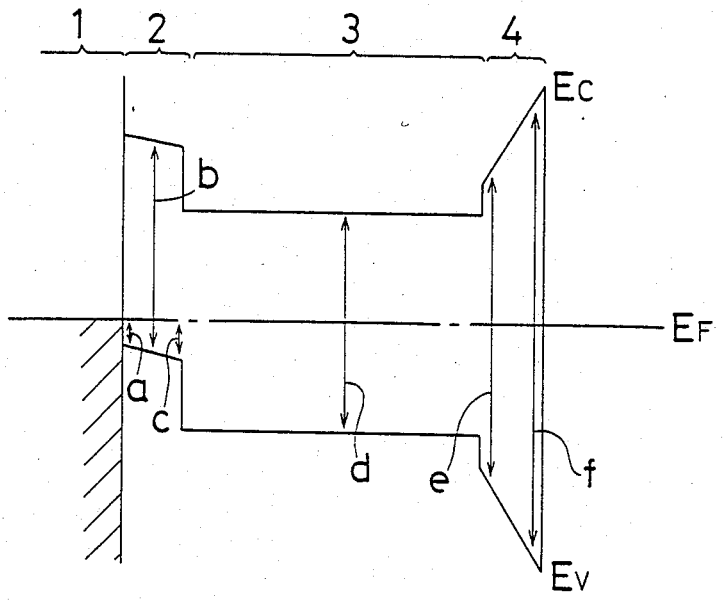
FIGS. 3 to 14 are energy band diagrams showing energy levels in the direction of thickness of photosensitive members embodying the examples.
Figure 4:
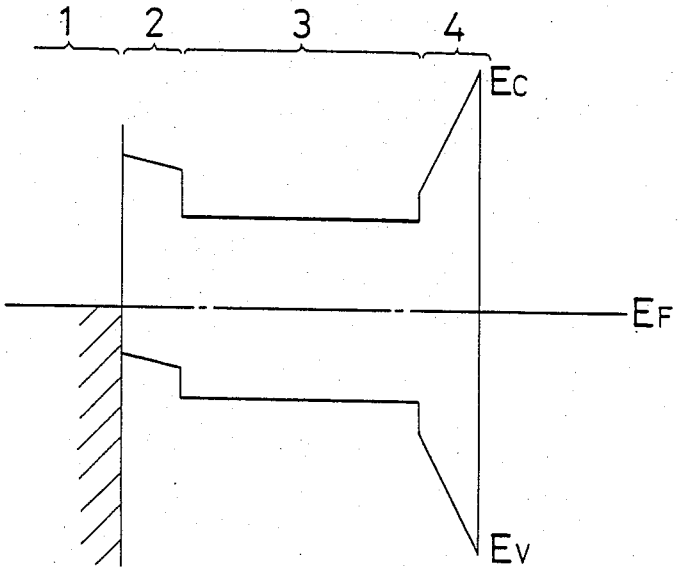
Figure 5:
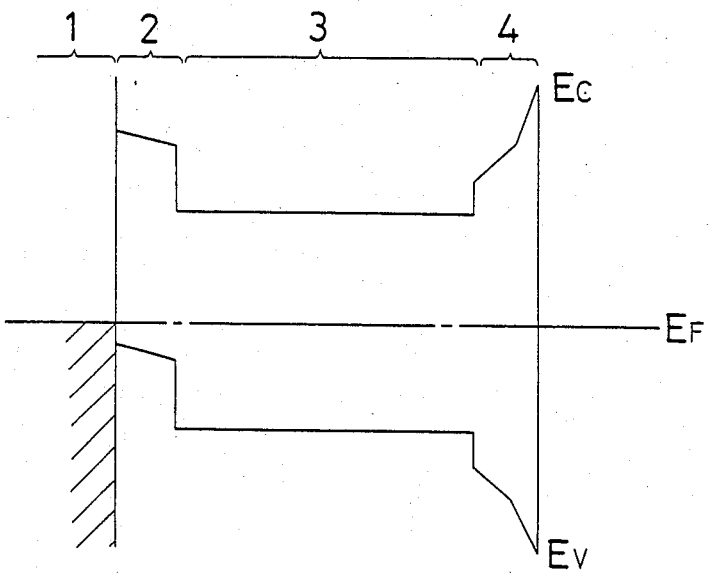
Figure 6:
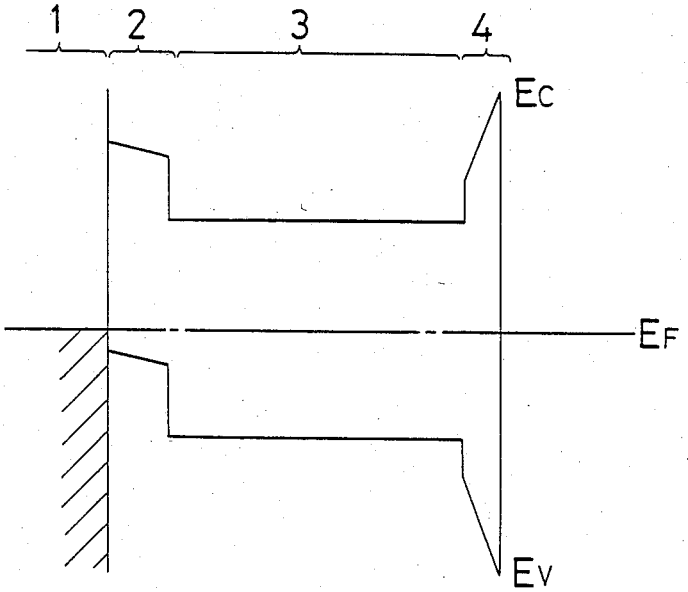
Figure 7:
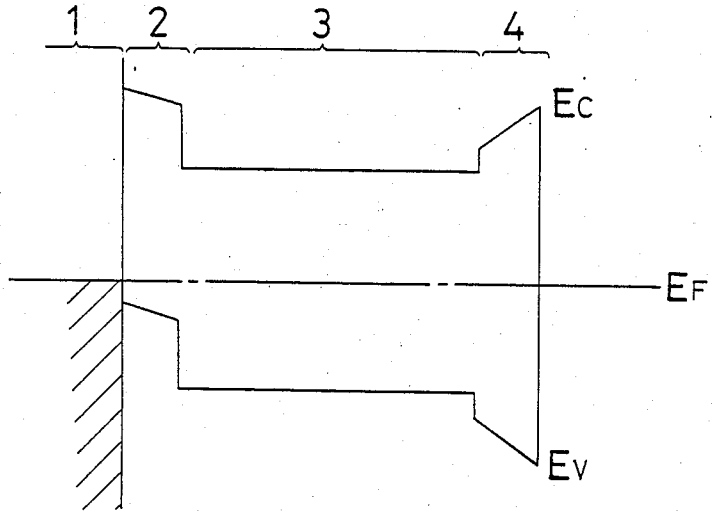
Figure 8:
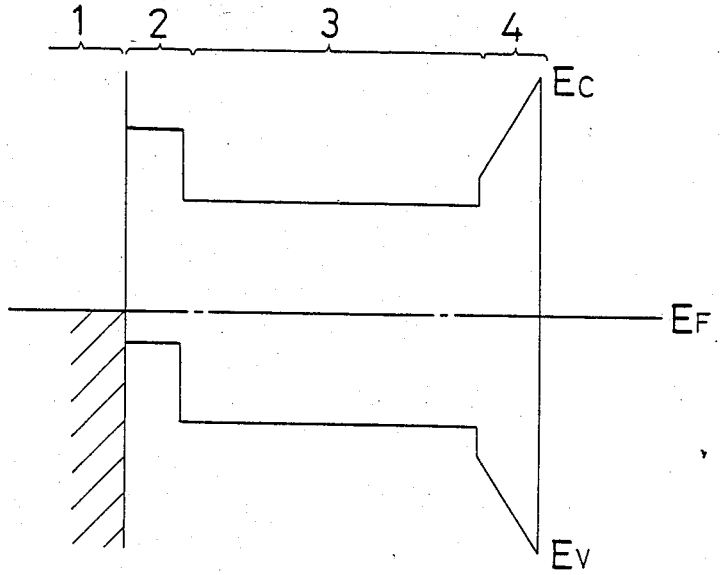
Figure 9:
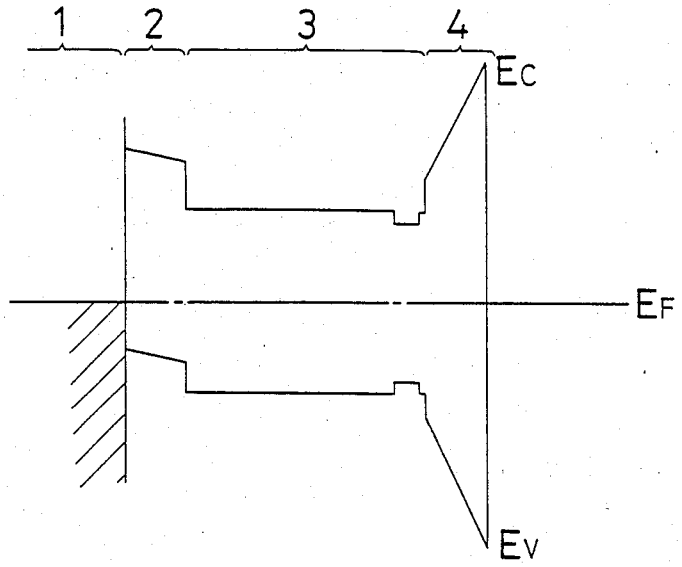
Figure 10:
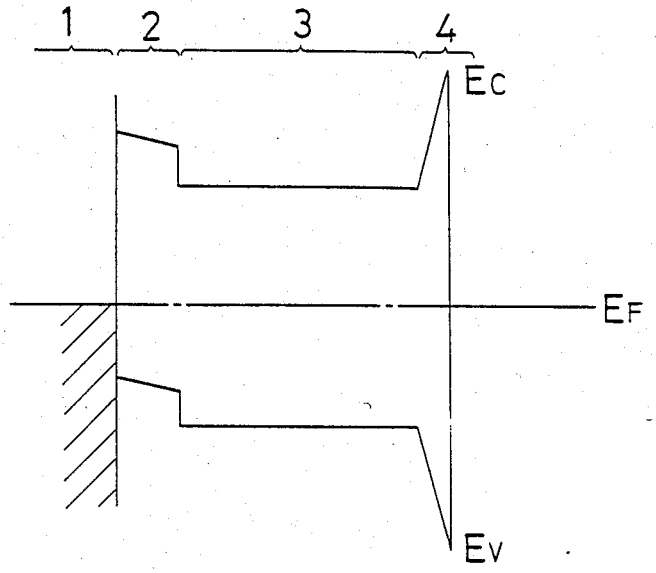
Figure 11:
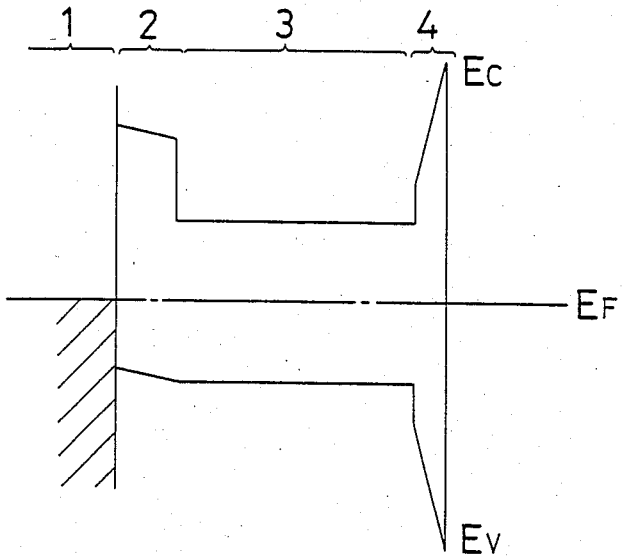

| Reference Example No. | Variations in amount of charge | Copying test (No. of blurless copies) | Temp.-humidity cycle test | Energy band diagram |
|---|---|---|---|---|
| I | Within ±5% | 200,000 | Good | FIG. 3 |
| II | Within ±5% | 200,000 | Good | FIG. 4 |
| III | Within ±10% | 50,000 | Good | FIG. 5 |
| IV | Within ±5% | 50,000 | Good | FIG. 6 |
| V | Within ±5% | 100,000 | Good | FIG. 7 |
| VI | Within ±5% | 100,000 | Good | FIG. 8 |
| VII | Within ±5% | 100,000 | Good | FIG. 9 |
| VIII | Within ±5% | 100,000 | Good | FIG. 10 |
| IV | Within ±5% | 100,000 | Good | FIG. 11 |
| Comp. Ex. I* | Within ±5% | 5,000 | Poor | — |
| Comp. Ex. II** | At least ±20% | 50,000 | Good | — |
| Comp. Ex. III | At least ±20% | 10,000 | Poor | — |
| Comp. Ex. IV | At least ±20% | 20,000 | Poor | — |

Note
*Single-layer drum.
**Conventional three-layer drum.

In FIGS. 3 to 11 and 12 to 14, plotted as ordinate are energy levels in the case of positive charging. Indicated as $E_C$ is the conduction band, at $E_F$ the Fermi band, and at $E_V$ the valence band. The region indicated at 1 corresponds to the substrate, at 2 the blocking layer, at 3 the photoconductive layer, and at 4 the surface layer. In FIG. 3, the energy differences between $E_V$ and $E_F$ of between $E_V$ and $E_C$ are 0.2 eV for a, 1.75 eV for b, 0.3 eV for c, 1.8 eV for d, 2.4 eV for e, and 4.0 eV for f.

Thus, the photosensitive members of Reference Examples I to IX are chargeable with reduced variations in the amount of charge and found to have outstanding characteristics by the copying test and temperature-humidity cycle test.

Further, the photosensitive members of Comparative Examples III and IV wherein oxygen is incorporated in the surface layer in place of carbon are inferior to the members of Reference Examples I to IX, especially in the useful life of the member.

REFERENCE EXAMPLE X

A blocking layer and a photoconductive layer were formed over a substrate under the same conditions as in Reference Example I, and a surface layer was thereafter formed at stepwise varying $CH_4/SiH_4$ ratios as given below, whereby a photosensitive member was obtained. The $H_2/SiH_4$ ratio was the same as in Reference Example I.

| Reaction time | $CH_4SiH_4$ |
|---|---|
| Initial period (6 min.) | 0.2 |

-continued

| Reaction time | $CH_4SiH_4$ |
|---|---|
| Intermediate period (6 min.) | 2.8 |
| Final Period (8 min.) | 4.0 |

Figure 12:
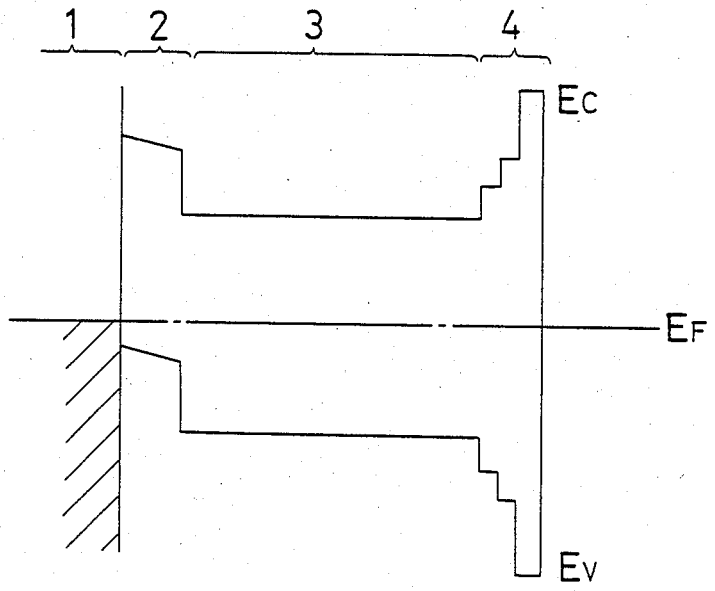

FIG. 12 is the energy band diagram of the photosensitive member thus obtained. The stepwise gradient pattern of $CH_4/SiH_4$ ratio was found to correspond to the energy level pattern of the surface layer.

The photosensitive member exhibited the same performance as the member obtained in Reference Example I.

REFERENCE EXAMPLE XI

Figure 13:
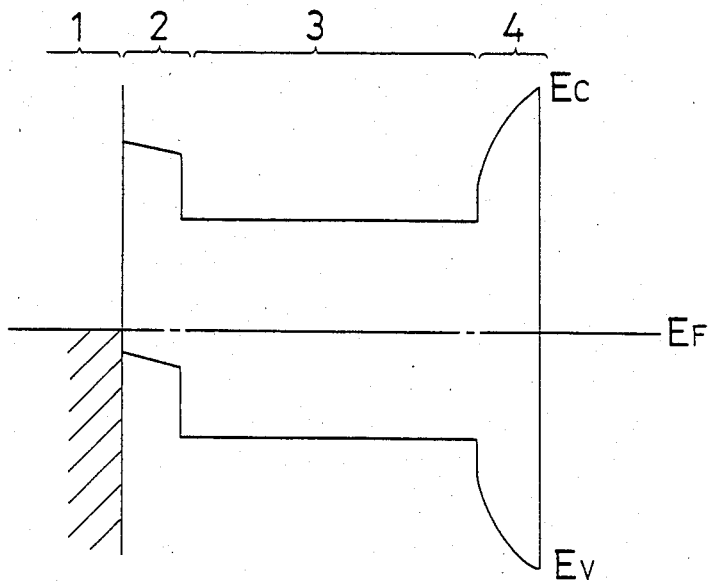

A photosensitive member was prepared in the same manner as in Reference Example IX except that the gradient of $CH_4/SiH_4$ ratio was made to have an arcuate pattern. FIG. 13 is the energy band diagram of this member. The member exhibited the same performance as the one prepared in Reference Example I.

REFERENCE EXAMPLE XII

A photosensitive member was prepared in the same manner as in Reference Example IX with the exception of varying the $CH_4/SiH_4$ as listed below.

| Reaction time | $CH_4/SiH_4$ |
|---|---|
| Initial period (6 min.) | 0.2 |
| Intermediate period I (3 min.) | $0.2 \rightarrow 0$ |
| Intermediate period II (3 min.) | $0 \rightarrow 0.2$ |
| Final period (8 min.) | $0.2 \rightarrow 2.8$ |

Figure 14:
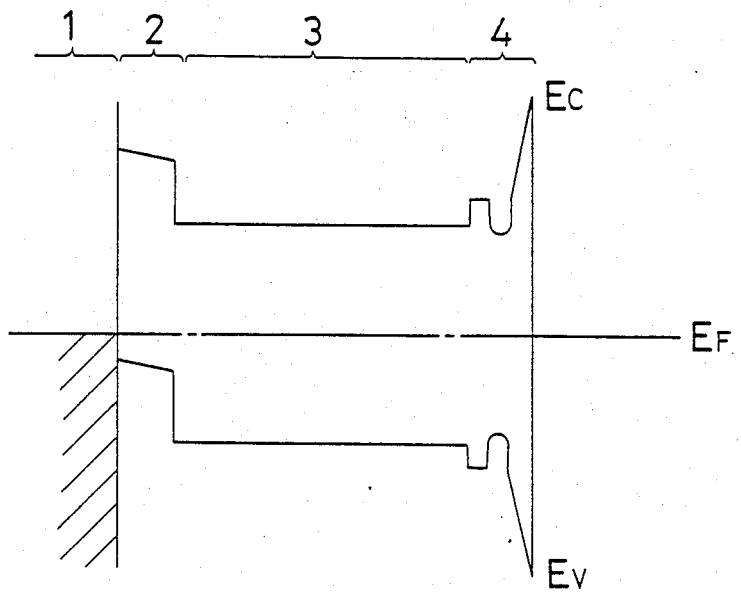

FIG. 14 is the energy band diagram of the member thus obtained. The member exhibited the same performance as the one prepared in Reference Example I.

REFERENCE EXAMPLE XIII

A blocking layer and a photoconductive layer were formed under the same conditions as in Reference Example I, and a surface layer was thereafter formed under the same conditions as in Reference Example I with the exception of additionally using $B_2H_6$ gas in an amount of 100 ppm based on the $SiH_4$ gas, whereby diminished dark decay was realized. This effect appears attributable to the presence of the small amount of boron acting to render the surface layer more intrinsic.

REFERENCE EXAMPLE XIV

A blocking layer and a photoconductive layer were formed under the same conditions as in Reference Example I, and a surface layer was thereafter formed under the same conditions as in Reference Example I except that the gas obtained by evaporating $(CH_3)_3Ga$ by the liquid bubbling method with use of $H_2$ as a carrier gas was additionally used in an amount of 1% based on the $SiH_4$ gas, whereby dark decay was diminished. This effect appears attributable to the presence of Ga acting as p-type silicon to render the surface layer more intrinsic.

REFERENCE EXAMPLE XV

A photosensitive member was prepared under the same conditions as in Reference Example I except that the photoconductive layer was formed without using $B_2H_6$ gas but using the gas obtained by evaporating $(CH_3)_3Ga$ by the liquid bubbling method with use of $H_2$ as a carrier gas, in an amount of 0.2% based on the $SiH_4$ gas. Consequently diminished dark decay was realized. This effect appears attributable to the present of Ga acting as p-type silicon to render the photoconductive layer more intrinsic.

REFERENCE EXAMPLE XVI

A photoconductive layer and a surface layer were formed over a substrate under the same conditions as in Reference Example I. The substrate was a hollow aluminum cylinder coated with chromium by electron beam vacuum evaporation. Although having no blocking layer, the photosensitive member obtained was comparable to the one prepared in Reference Example V in respect of photoconductive characteristics and durability.

EXAMPLE I

A hollow stainless steel cylinder was coated with W by electron beam vacuum evaporation to obtain a substrate, which was further coated with an amorphous silicon film having a thickness of hundreds of angstroms. The surface of the substrate was then heated by a YAG laser to convert the silicon to W silicide. A photoconductive layer and a surface layer were thereafter formed over the substrate under the same conditions as in Reference Example I.

The photoconductive layer was formed with greater bond strength than when an amorphous silicon layer is formed directly over stainless steel.

EXAMPLE II

A hollow stainless steel cylinder was coated with Mo by electron beam vacuum evaporation to obtain a substrate. Si ions were injected into the substrate which was heated at 400° C., followed by ion beam mixing to form Mo silicide. A photoconductive layer and a surface layer were thereafter formed over the substrate under the same conditions as in Reference Example I.

The photoconductive layer was formed with greater bond strength than when an amorphous silicon layer is formed directly over stainless steel.

[Test]

The following tests were conducted for the evaluation of performance of the photosensitive members having a silicide layer as obtained in Examples I and II.

(i) Adhesion Test

Silicide layer was each formed on aluminum plates in various thickness by the method as described in Example I, and then the amorphous silicon layer having a thickness of 5 82 m was formed thereon to obtain samples of this invention.

For comparison's sake, a sample was prepared which was directly formed on an aluminum plate the amorphous silicon layer of 5 μm in thickness.

Adhesive strength between the aluminum plate and the amorphous silicon layer was measured for each of samples according to the methods defined in JIS K 6856 "Testing methods for flexural strength of adhesives". The results are shown in Table 3.

TABLE 3

| Thickness of Mo Silicide layer (Å) | Adhesive strength ($Kg/mm^2$) |
|---|---|
| 0 | 5 |
| 500 | 20 |
| 1000 | 35 |
| 5000 | 65 |
| 8000 | 70 |

TABLE 3-continued

| Thickness of Mo Silicide layer (Å) | Adhesive strength ($Kg/mm^2$) |
|---|---|
| 10000 | 71 |

(ii) Copying test and Temperature-humidity cycle test

Two kinds of photosensitive drums A and B were prepared.

Photosensitive drum A was prepared by forming over a hollow stainless steel cylinder W silicide layer of 1000 Å in thickness as described in Example I and forming a photoconductive layer and a surface layer on the silicide layer under the same conditions as in Reference Example I.

Photosensitive drum B was prepared by forming over the cylinder Mo silicide layer of 1000 Å in thickness as described in Example II and forming a photoconductive layer and a surface layer on the silicide layer as in Reference Example I.

For comparison, a drum was prepared which was directly formed on the cylinder a photoconductive layer and a surface layer (Comparison drum).

Each of the drums was subjected to copying test and temperature-humidity cycle test as aforementioned. The results are shown in Table 4.

TABLE 4

| | Copying test (Number of blurless copies) | Temperature-humidity cycle test |
|---|---|---|
| Drum A | >100000 | Good |
| Drum B | >100000 | Good |
| Comparison Drum | 5000 | Poor* |

*A part of the photoconductive layer peeled from the cylinder.

REFERENCE EXAMPLE XVII

A photosensitive member was prepared under the same conditions as in Reference Example I except that the substrate used was made of a nonmetallic heat generating material, i.e. silicon carbide, and lined with a metal (e.g. Al) coating.

The member was usable without blur of images that could result from condensation of water vapor, when it was heated to 40° to 50° C. with application of low voltage.

REFERENCE EXAMPLE XVIII

A photosensitive member was prepared under the same conditions as in Reference Example I except that the substrate used was a hollow cylinder of aluminum having a high purity of at least 99.9% (A1090 according to JIS).

Because the substrate was made of high-purity aluminum and was freer from surface defects due to impurities (Fe, Cu, Si, Mn, Mg, etc.) in the aluminum, the amorphous silicon layers were formed with a reduced number of pinholes.

EXAMPLE III

A molybdenum silicide film was formed over a substrate by a radio-frequency spattering, using a target having an Mo/Si area ratio of 0.3 and heating the substrate at 200° C. A photoconductive layer and a surface layer were thereafter formed under the same conditions as in

REFERENCE EXAMPLE I.

The photosensitive member obtained had high bond strength and good durability although slightly inferior to those of other example in blocking effect.

REFERENCE EXAMPLE XVI

The surface of a hollow copper cylinder was subjected to thermal oxidation or oxygen plasma treatment to form a copper oxide film over the substrate surface. A photoconductive layer and a surface layer were thereafter formed under the same conditions as in Reference Example I. Although having no blocking layer of amorphous silicon, the photosensitive member obtained had satisfactory blocking characteristics in addition to the advantages afforded by the present invention, owing to the presence of a hetero barrier between the copper oxide and the photoconductive layer.

REFERENCE EXAMPLE XX

A GaP film was formed over a substrate by a plasma reaction in a gas mixture of $(CH_3)_3Ga$, P vapor and $(CH_3)_2Zn$ A photoconductive layer and a surface layer were thereafter formed under the same conditions as in Reference Example I. The photosensitive member obtained had satisfactory blocking characteristics in addition to the advantages afforded by the present invention, owing to a hetero barrier present between the GaP and the photosensitive member.

REFERENCE EXAMPLE XXI

A blocking layer and a photoconductive layer were formed over a substrate under the same conditions as in Reference Example I, and the surface of the resulting amorphous silicon layer was treated with plasma in $NH_3$ gas. Without any interruption, a surface layer was thereafter formed under the same conditions as in Reference Example I.

The photosensitive member obtained exhibited improved photosensitivity and a reduction in residual potential. These effects appear attributable to the plasma treatment in $NH_3$ resulting in diminished electron traps between the surface layer and the photoconductive layer.

What we claim is:

1. An electrophotographic photosensitive member comprising:
   (a) a substrate made of an electrically conductive material;
   (b) a silicide layer formed on the surface of the substrate wherein the silicide is selected from the group consisting of Co silicide, Mo silicide, and W silicide; and
   (c) a photoconductive layer superposed on the silicide layer being composed chiefly of amorphous silicon and containing hydrogen.

2. A photosensitive member as defined in claim 1 wherein the substrate is made of aluminum or stainless steel.

3. A photosensitive member as defined in claim 1 wherein the silicide layer has a thickness of 10–10000Å.

4. A photosensitive member as defined in claim 1 wherein the photoconductive layer has a surface layer having charge retaining ability.

* * * * *

UNITED STATES PATENT AND TRADEMARK OFFICE

CERTIFICATE OF CORRECTION

PATENT NO. : 4,786,572

DATED : November 22, 1988

INVENTOR(S) : HISAO HAKU et al.

It is certified that error appears in the above-identified patent and that said Letters Patent is hereby corrected as shown below:

Column 2, Line 22: Delete space between "photo" and "sensi-".

Column 3, Line 16: Change "$(C_2H(CH_3)_3Ga$" to --$(C_2H_5)_3Al$, $(CH_3)_3Ga$--.

Column 3, Line 18: After "layer is" add --a--.

Column 4, Line 33: After "sources," add --there--.

Column 10, Line 51: Change "5 82m" to --5 μm--.

Column 12, Line 2: Change "REFERENCE EXAMPLE I." to --Reference Example I.-- and make this the end of the immediately preceding sentence and not a heading.

Column 12, Line 25: After "$(CH_3)_2Zn$" add a period.

Signed and Sealed this

Fifth Day of May, 1992

*Attest:*

DOUGLAS B. COMER

*Attesting Officer*

*Acting Commissioner of Patents and Trademarks*